US007352273B2

(12) United States Patent
Tanimura

(10) Patent No.: US 7,352,273 B2
(45) Date of Patent: Apr. 1, 2008

(54) CHIP RESISTOR

(75) Inventor: Masanori Tanimura, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 11/429,348

(22) Filed: May 5, 2006

(65) Prior Publication Data

US 2006/0194402 A1 Aug. 31, 2006

Related U.S. Application Data

(62) Division of application No. 10/346,911, filed on Jan. 15, 2003, now Pat. No. 7,103,965.

(30) Foreign Application Priority Data

Jan. 17, 2002 (JP) ..... 2002-008523

(51) Int. Cl.
*H01C 1/012* (2006.01)

(52) U.S. Cl. ..... 338/309; 338/307

(58) Field of Classification Search ..... 338/307–309, 338/327–328

See application file for complete search history.

(56) References Cited

U.S. PATENT DOCUMENTS

| | | | | |
|---|---|---|---|---|
| 4,806,159 A | | 2/1989 | De Keyser et al. | |
| 5,022,263 A | | 6/1991 | Uriu et al. | |
| 5,866,194 A | * | 2/1999 | Ogawa et al. | 427/8 |
| 5,907,274 A | * | 5/1999 | Kimura et al. | 338/309 |
| 5,925,403 A | * | 7/1999 | Yoshizawa et al. | 427/126.3 |
| 5,990,781 A | | 11/1999 | Kambara | |
| 6,172,590 B1 | | 1/2001 | Shrier et al. | |
| 2002/0003466 A1 | * | 1/2002 | Yoneda | 338/313 |

FOREIGN PATENT DOCUMENTS

| | | | |
|---|---|---|---|
| JP | 6-45118 | | 2/1994 |
| JP | 7-147207 | | 6/1995 |
| JP | 7-176412 | | 7/1995 |
| JP | 9-69406 | | 3/1997 |
| JP | 2001351803 A | * | 12/2001 |

* cited by examiner

*Primary Examiner*—K. Richard Lee
(74) *Attorney, Agent, or Firm*—Hamre, Schumann, Mueller & Larson, P.C.

(57) ABSTRACT

The invention relates to a method of making a chip resistor using a material substrate for which are set a plurality of first cutting lines extending in a first direction and a plurality of second cutting lines extending in a second direction perpendicular to the first direction. The method includes an upper electrode forming step A for forming a thick upper conductor layer on the upper surface of the substrate by printing and baking a metal organic paste, a lower electrode forming step B for forming a thick lower conductor layer on the lower surface of the substrate by printing and baking metal organic paste, and a resistor element forming step C for forming a thin resistor layer by depositing a resistor material on the upper surface of the substrate. Preferably, the upper and the lower surfaces of the material substrate are flat.

3 Claims, 14 Drawing Sheets

CHIP RESISTOR

This application is a divisional application under 37 CFR § 1.53(b) of Ser. No. 10/346,911, filed on 15 Jan. 2003, entitled CHIP RESISTOR AND METHOD OF MAKING THE SAME.

BACKGROUND OF THE INVENTION

1. Field of the Invention

The present invention relates to a chip resistor provided with a thin-film resistor element, and also to a method of making the same.

2. Description of the Related Art

FIGS. 14 and 15 illustrate a chip resistor. The chip resistor 9 shown in these figures includes a insulating substrate 90, a pair of upper electrodes 91, a resistor element 92 connecting the paired upper electrodes 91, a pair of lower electrodes 93, a pair of end electrodes 94 connecting the upper electrodes 91 and the lower electrodes 93, a protective layer 95 covering the resistor element 92, and plating layers 96 for covering the electrodes 91, 93, 94.

The chip resistor 9, as shown in FIG. 16A, may be manufactured from a material substrate 9A which is formed with a plurality of dividing grooves 97A, 97B extending vertically and horizontally and setting a plurality of chip resistor forming regions 98 arranged vertically and horizontally.

Thick film printing may separately form the pair of upper electrodes 91, the resistor element 92, and the pair of lower electrodes 93 shown in FIGS. 14 and 15. For example, by printing and baking a material paste on the material substrate 9A, materials to be the upper electrode 91, the lower electrode 93 and the resistor element 92 can be collectively formed for the chip resistor-forming region 98 (see FIG. 16A) FIG. 16B shows an example of the material substrate 9A having an upper surface formed with a plurality of conductor materials 91A to be the upper electrodes 91. At a final stage, the material substrate is cut along the dividing grooves to provide separate chip resistors 9.

In thick film printing, lead glass paste dispersed with conductor particles is generally used as a material paste. However, considering environmental problems, it is undesirable to use a lead-contained glass paste.

The use of the material substrate 9A provided with dividing grooves 97A, 97B shown in FIG. 16A may cause the following problems due to miniaturization of the chip.

A first problem is caused by the material paste flowing into the dividing grooves 97A, 97B. In the material paste printing, the material paste may flow into the dividing groove 97A, 97B. Referring to FIG. 17, when the material paste for the upper electrode flows into the dividing groove 97A, the conductor materials 91A adjacent in the extending direction of the dividing groove 97A may be electrically connected to each other. After the upper surface of the material substrate 9A is formed with a resistor element 92, the resistance of the resistor element 92 is measured. Then, the resistance of the resistor element 92 is adjusted. In the measurement of the resistance, the conductor element 91A is held in contact with a probe P. Thus, with the adjacent conductor materials 91A connected electrically, the resistor element 92 connecting between the conductor materials 91A completes a parallel circuit, which impedes proper measurement of the resistance of the resistor element 92. In particular, the miniaturization of the chip causes a distance reduction between the adjacent upper electrodes 91 (the conductor materials 91A), which tends to lead to disadvantages described above. Further, the material paste flowing into the dividing groove 97A, 97B remains on a fringe of a product (chip resistor) when the material substrate 9A is divided along the dividing grooves 97A, 97B, which deteriorates the appearance.

To eliminate such disadvantages caused by the material paste flowing into the dividing grooves 97A, 97B, an excess may be removed by etching after baking the material paste. However, the miniaturization of the chip leads to a width reduction of the dividing grooves 97A, 97B, which impedes the removal of the excess remaining in the dividing grooves 97A, 97B. Further, the additional process of etching results in a decline in production efficiency.

A second problem is an increase in rejection rates in mounting. When the material substrate 9A is divided along the dividing grooves 97A, 97B with external force, the chip may be chipped off and deteriorate in shape. In particular, the small chip is greatly influenced in shape by being chipped off, which tends to lead to the increase in rejection rates in mounting.

A third problem is a decrease in yielding percentage. As the chip is downsized, the material substrate 9A needs to be reduced in thickness. In that case, the dividing grooves 97A, 97B formed on the material substrate 9A may contribute to generation of a crack on the material substrate 9A in such steps as printing or baking the material paste. As a result, the increase in rejection rate leads to the decrease in yielding percentage, which increases manufacturing costs.

SUMMARY OF THE INVENTION

It is therefore an object of the present invention to provide a method of making a chip resistor to provide the chip resistor containing no leads, to properly adjust a resistance of a resistor material, and further to prevent a rejection in mounting caused by a miniaturization of the chip and a reduction of a yielding percentage.

According to a first aspect of the present invention, there is provided a method of making a chip resistor with use of a material substrate for which are set a plurality of first cutting lines extending in a first direction and a plurality of second cutting lines extending in a second direction perpendicular to the first direction. The method comprises: a first conductor layer forming step for forming a first conductor layer, as a thick layer, on a first surface of the material substrate by printing and baking a metal organic paste; a second conductor layer forming step for forming a second conductor layer, as a thick layer, on a second surface opposite the first surface of the material substrate by printing and baking a metal organic paste; and a resistor layer forming step for forming a resistor layer, as a thin film, by depositing of a resistor material on the first surface of the material substrate.

The metal organic paste may include resinated silver or resinated gold.

Preferably, the first and second surfaces of the material substrate are flat.

The second conductor layer forming step may include an operation of forming a plurality of conductor layer strips extending in the first direction along the first cutting lines on the second surface of the material substrate.

The first and second conductor layers are formed in 2000-3000 Å of thickness for example.

The resistor layer forming step may include an operation of forming a preliminary resistor layer by depositing of a resistor material entirely or substantially entirely over the first surface of the material substrate, while also including an operation of applying an etching treatment to the preliminary resistor layer.

Preferably, the etching treatment is performed so that the resistor layer entirely covers the first conductor layer.

The resistor layer forming step may be performed by depositing the resistor material on the first surface of the material substrate with use of a mask formed with an opening or openings.

Preferably, the opening is formed so that the first conductor layer is entirely exposed, or that a region of the first surface of the material substrate to be formed with the first conductor layer is exposed.

The resistor layer is formed in 1000-2000 Å of thickness for example.

The method of making the chip resistor of the present invention further may further comprise a cutting step for cutting the material substrate along the first cutting lines into a plurality of strips.

Preferably, the cutting step utilizes a rotatable blade or a laser beam.

The method of making the chip resistor of the present invention may further comprise a third conductor layer forming step after the cutting step for forming a third conductor layer, as a thick layer, made from a conductive resin paste on a cut surface of the strip.

The third conductor layer is formed in 10-30 μm of thickness for example.

The method of making the chip resistor of the present invention may further comprise an additional cutting step for cutting the strip along the second cutting lines.

Preferably, the additional cutting step utilizes a rotatable blade or a laser beam.

According to a second aspect of the present invention, there is provided a method of making a chip resistor with use of a material substrate for which are set a plurality of first cutting lines extending in a first direction and a plurality of second cutting lines extending in a second direction perpendicular to the first direction, the material substrate having a first surface and a second surface opposite the first surface. The method comprises: a first conductor layer forming step for forming a first conductor layer, as a thick layer, on the first surface of the material substrate; a second conductor layer forming step for forming a second conductor layer, as a thick layer, on the second surface; a resistor layer forming step for forming a resistor layer in a thin film by depositing of a resistor material on the first surface of the material substrate; a first cutting step for cutting the material substrate along the first cutting lines into a plurality of strips; a third conductor layer forming step for forming a third conductor layer on a cut surface of the strip; and a second cutting step for cutting the strips along the second cutting lines; at least one step of the first cutting step and the second cutting step utilizes a rotatable blade or a laser beam.

According to a third aspect of the present invention, there is provided a chip resistor comprising: a substrate having a first surface and a second surface opposite the first surface; a pair of first electrodes formed thick from a metal organic paste on the first surface of the material substrate; a pair of second electrodes formed thick from a metal organic paste on the second surface of the material substrate; and a thin-film resistor element connecting between the paired first electrodes on the first surface of the material substrate.

The chip resistor of the present invention may further comprise a third electrode connecting the first electrode and the second electrode. Preferably, the third electrode is formed in a thick layer made from a conductive resin paste.

Preferably, the first electrodes are entirely covered with the thin film resistor element.

DETAILED DESCRIPTION OF THE PREFERRED EMBODIMENT

Figure 1:
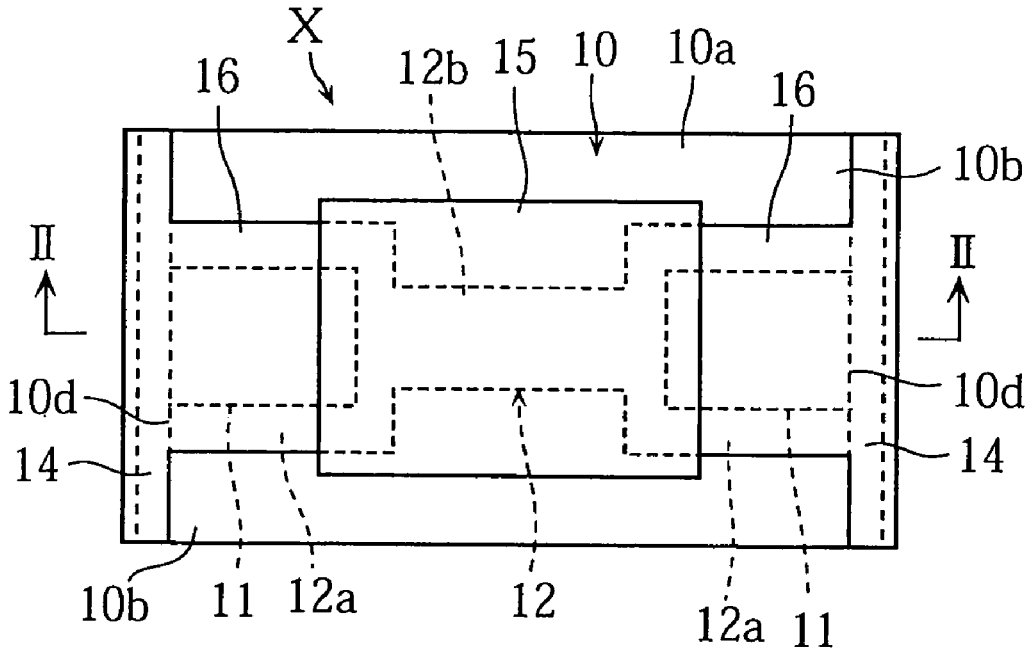
FIG. 1 is a plan view showing an example of a chip resistor according to the present invention.
Figure 2:
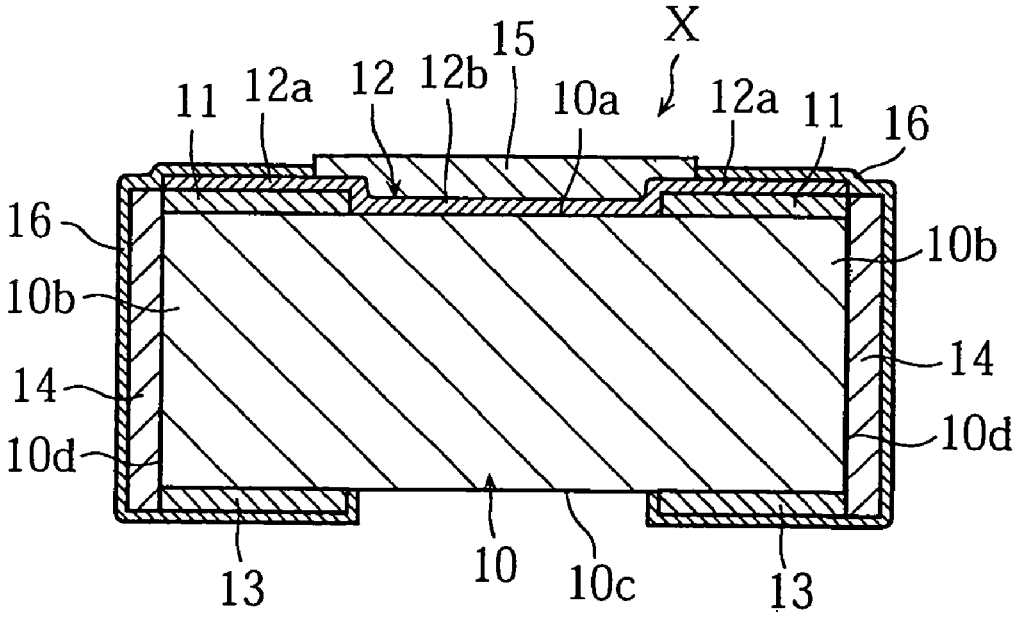
FIG. 2 is a sectional view taken along the line II-II in FIG. 1.

A chip resistor X illustrated in FIGS. 1 and 2 comprises an insulating substrate 10, a pair of upper electrodes 11, a resistor element 12, a pair of lower electrodes 13, a pair of end electrodes 14, a protective layer 15 and plating layers 16.

The insulating substrate 10 is in the form of a substantially rectangular parallelepiped, made of insulating material such as alumina.

The pair of upper electrodes 11 are spaced apart from each other on an upper surface 10*a* of the insulating substrate 10.

Each upper electrode 11 is formed by printing and baking a metal organic paste in a thick layer having a thickness of 2000-3000 Å for example.

The resistor element 12 is formed on the upper surface 10*a* of the insulating substrate 10 so as to connect between the paired upper electrodes 11. The resistor element 12, made of Ni-Cr or Ta, is in the form of a thin film having a thickness of 1000-2000 Å for example. The resistor element 12 includes an end portion 12*a* entirely covering the upper electrode 11. The resistor element 12 includes a center portion 12*b* having a width smaller than the end portion 12A. However, the resistor element is not limited to that illustrated, and may be in the form of having an uniform width or in any other form.

The paired lower electrodes 13 are spaced apart from each other on the lower surface 10*c* of the insulating substrate 10. Each lower electrode 13 is formed by printing and baking an metal organic paste in a thick layer having a thickness of 2000-3000 Å for example.

The paired electrodes 14 are respectively formed on one of side surfaces 10*d* of the insulating substrate 10 to connect the upper electrode 11 and the lower electrode 13. The end electrode 14 is in the form of a thick layer having a thickness of 10-30 μm for example, made from a conductive resin paste.

The protective layer 15 covers the center portion 12*b* of the resistor element 12. The protective layer 15 is provided for protecting the center portion 12*b* of the resistor element 12 from external force or the like, and for avoiding that a resistor element adheres to the resistor material in a step of forming the plating layer 16, and further for preventing the resistor element 12 from being stripped off.

The plating layer 16 covers the end portion 12*a* of the resistor element 12, the end electrodes 14, and the lower electrodes 13 that are not covered with the protective layer 15. The plating layer 16 is provided to protect the end portion 12*a* of the resistor element 12, the end electrodes 14, and the lower electrodes 13 from external force and the like, and to prevent the resistor element 12 from being stripped off. Further, the plating layer 16 is provided to enhance a solder wetting characteristic of the chip resistor X, and to prevent the corrosion of the end electrode 14 and the lower electrode 13 when the chip resistor X is mounted on a circuit board or the like.

Figure 3:
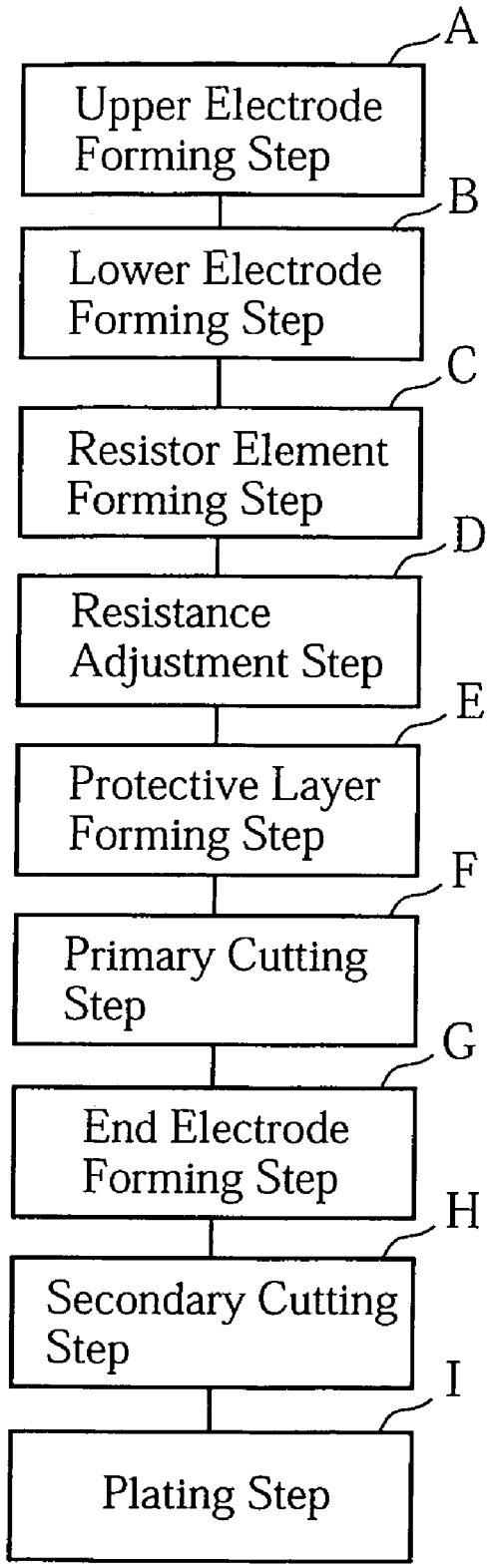
FIG. 3 is a manufacturing flow chart showing a method of making the chip resistor according to the present invention.
Figure 4A:
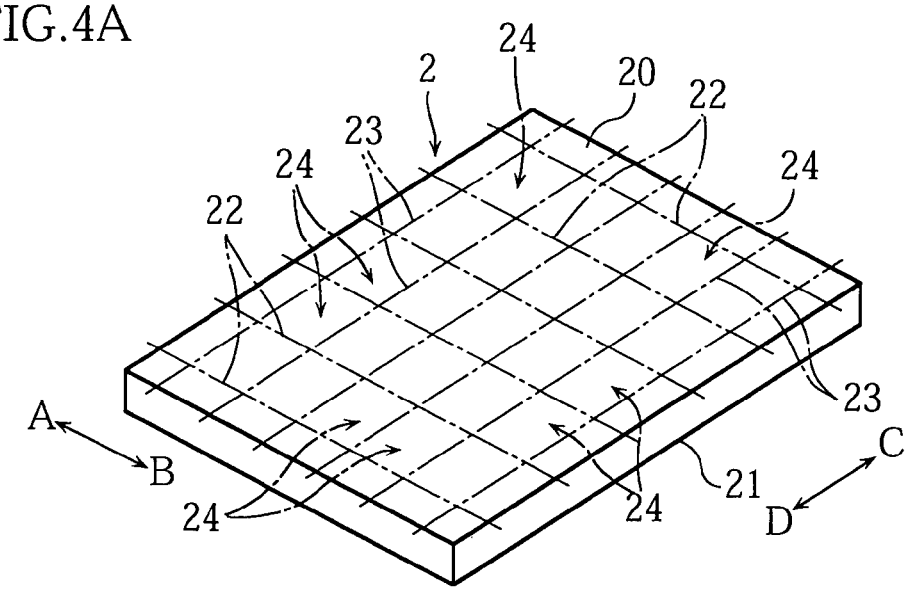
FIG. 4A is a perspective view of a material substrate used in the method of the present invention.

The chip resistor X shown in FIGS. 1 and 2 may be manufactured by steps A-I shown in FIG. 3. In the steps A-I, as shown in FIG. 4, use is made of the material substrate 2 provided with the upper surface 20 and the lower surface 21 both of which are flat. This means that the material substrate 2 used in the present embodiment is formed with no dividing grooves. For the material substrate 2, first cutting lines 22 are set to extend in the direction of an arrow AB in the figure, and second cutting lines 23 are set to extend in the direction of an arrow CD. The cutting lines 22 and 23 define rectangular regions, or chip resistor forming regions 24. The chip resistor forming regions 24 are aligned vertically and horizontally of the material substrate 2. The material substrate 2 is made of insulating material such as alumina, and dimensioned 10-100 mm×50-100 mm×0.1-0.3 mm.

The illustrated first and second cutting lines 22 and 23 are imaginary and not drawn on the material substrate 2. Alternatively, the cutting lines may be actually drawn on the upper surface 20 and the lower surface 21 of the material substrate 2.

The upper electrode forming step A and the lower electrode forming step B shown in FIG. 3 are performed by printing and baking metal organic paste.

In printing the metal organic paste, either of the upper surface 20 and the lower surface 21 of the material substrate 2 (see FIG. 4A) is covered by a mask having an opening (not shown). The opening is filled with the organic metal paste, and thereafter the mask is removed. As the metal paste, resinated gold or resinated silver may be used. Of course, other organic metals may also be used. For the baking operation, the material substrate 2 after the printing is put into a furnace and heated at 800-900° C. for 10-60 minutes, for example.

Figure 4B:
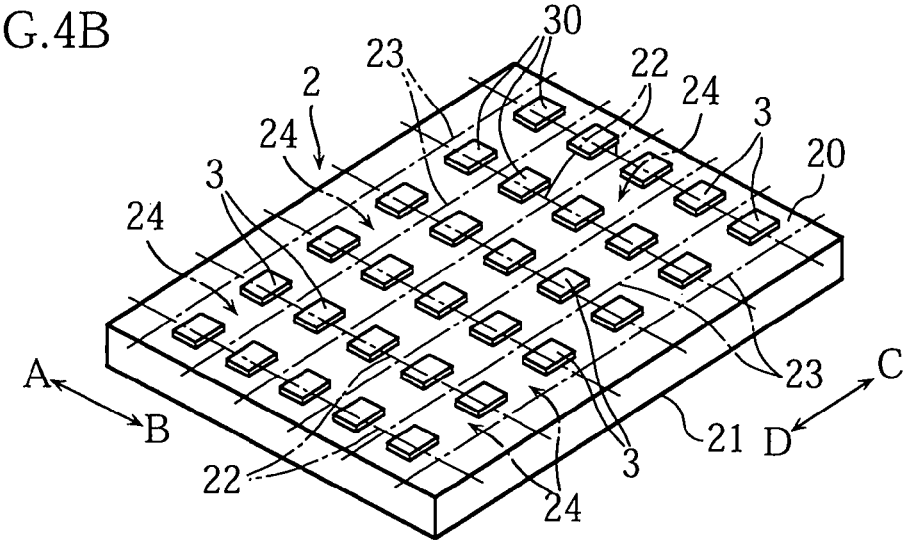
FIG. 4B is a perspective view showing an upper electrode forming step.

In the upper electrode forming step A, as shown in FIG. 4B, a plurality of upper conductor layers 30 to be the upper electrodes 11 (see FIGS. 1 and 2) are formed. The upper conductor layers 30 are located on and across a relevant first cutting line 22, and arranged in matrix so as to be spaced apart from each other in the both directions of the arrow AB and the arrow CD in the figure. Each upper conductor layer 30 may be formed as a thick layer having a thickness of 2000-3000 Å.

Figure 4C:
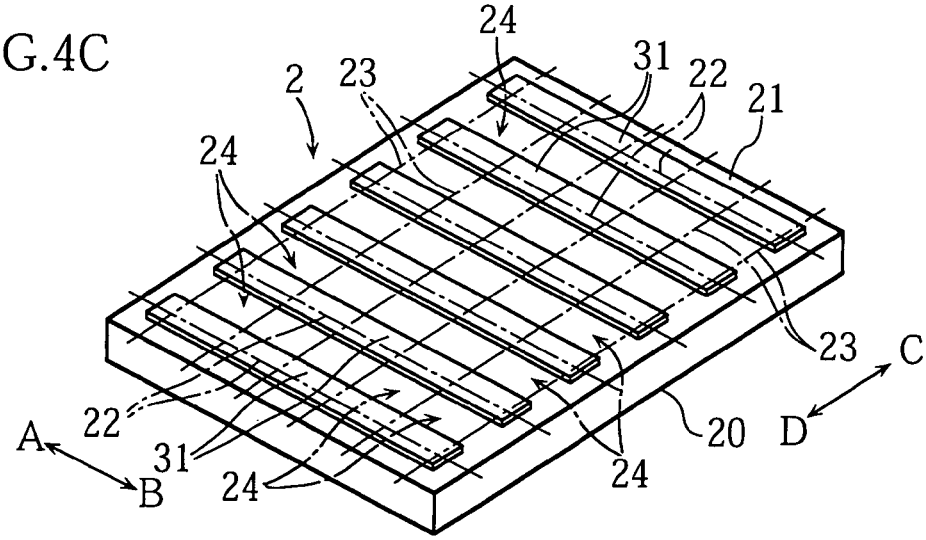
FIG. 4C is a perspective view showing a lower electrode forming step.

In the lower electrode forming step B, as shown in FIG. 4C, a plurality of lower conductor layers 31 to be the lower electrodes 13 (see FIGS. 1 and 2) are formed. The lower conductor layers 31 are formed in strips extending along the first cutting line 22 (extending in the direction of the arrow AB in the figure) and are spaced apart from each other in the direction of the arrow CD. The lower conductor layer 31 may be formed in a thick layer having a thickness of 2000-3000 Å.

Figure 5:
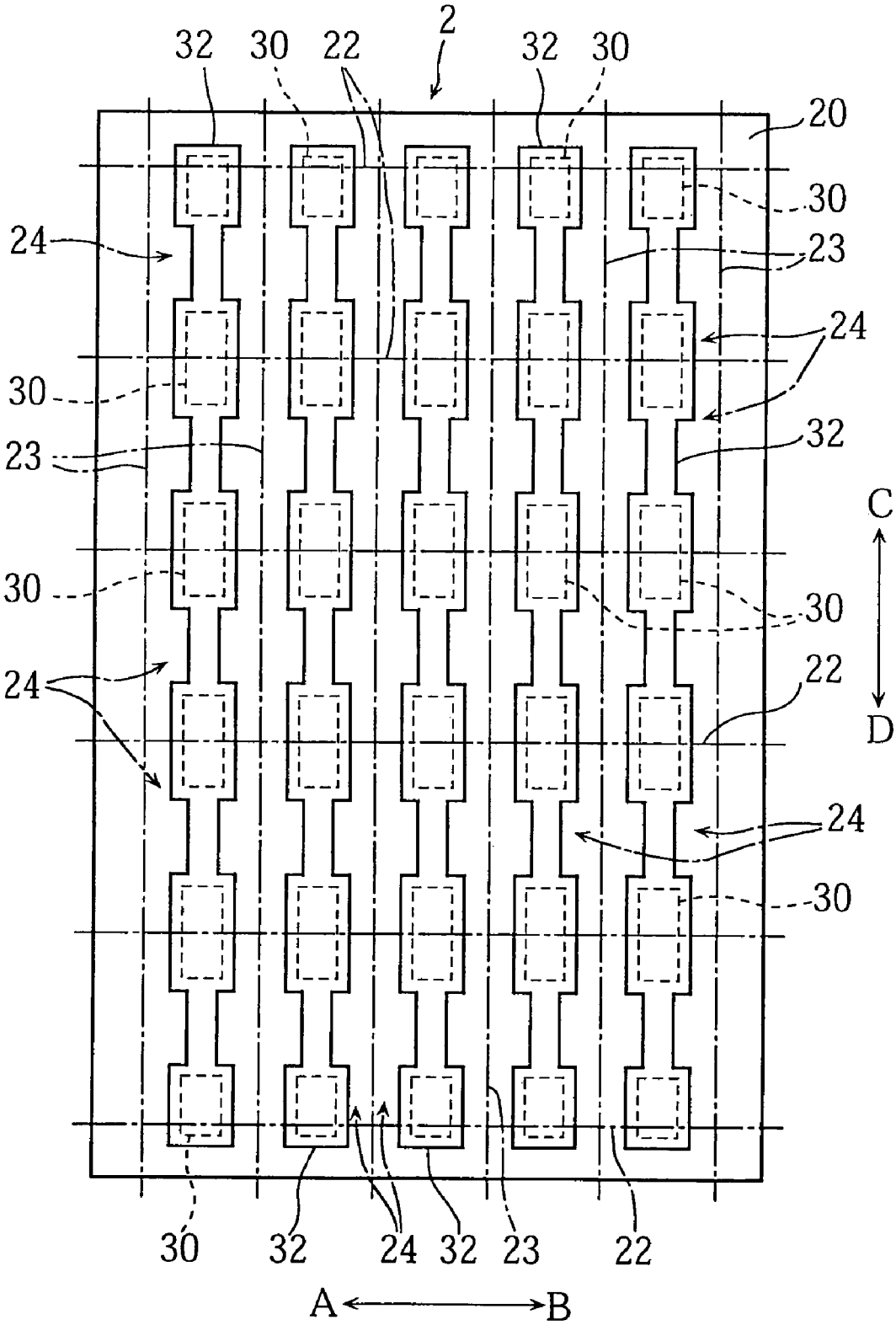
FIG. 5 is a plan view showing a resistor element forming step.
Figure 6:
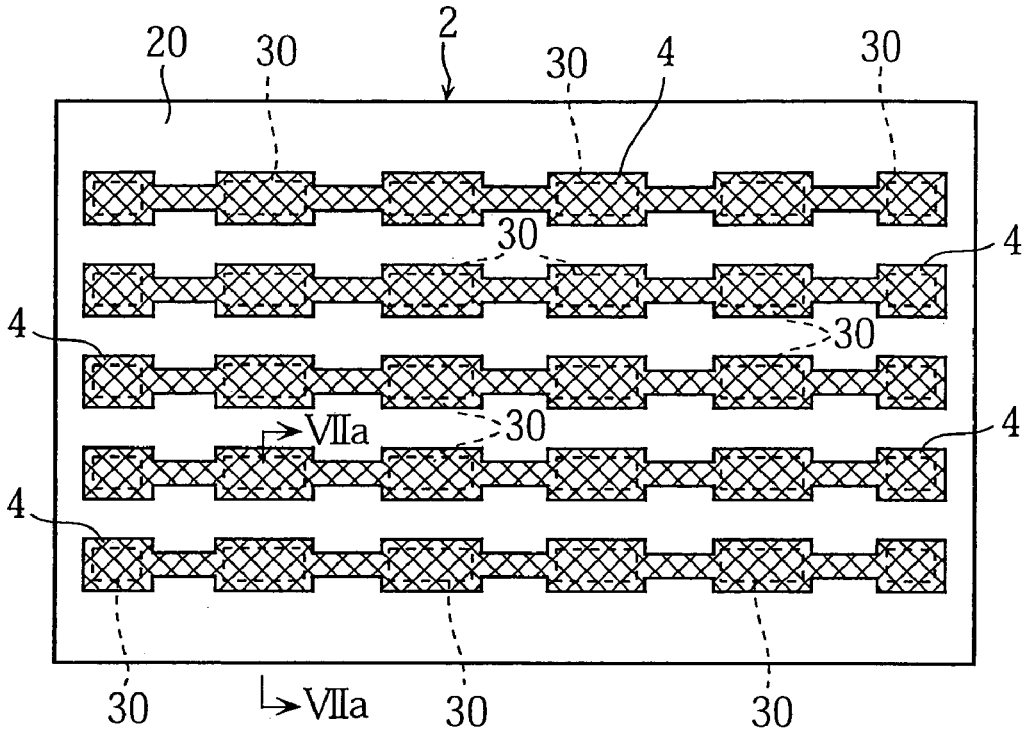
FIG. 6 is a plan view showing a resistor element forming step.
Figure 7A:
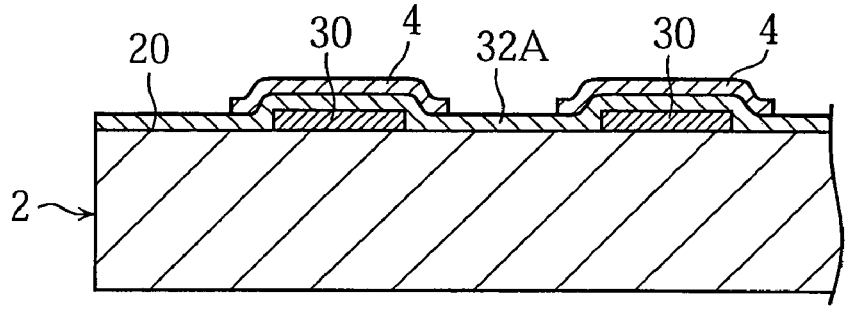
FIG. 7A is a sectional view taken along the line VIIa-VIIa in FIG. 6.
Figure 7B:
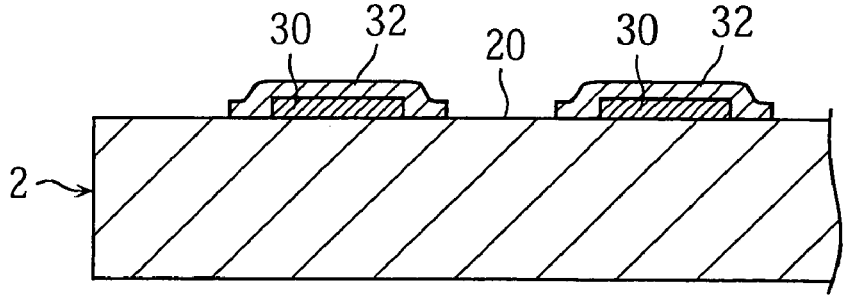
FIG. 7B is a sectional view taken along the line VIIa-VIIa in FIG. 6 after etching treatment.

In a resistor element forming step C shown in FIG. 3, a plurality of resistor layers 32 to be the resistor elements 12 (see FIGS. 1 and 2) are formed, as shown in FIG. 5. The resistor layers 32 are formed so as to entirely cover the upper resistor layers 30 and to collectively cover the upper conductor layers 30 arranged in the direction of the arrow CD. As shown in FIGS. 6, 7A and 7B, the resistor layer 32 is produced by forming a preliminary resistor layer 32A and then subjecting it to etching.

The preliminary resistor layer 32A may be formed as a Ni-Cr layer or a Ta layer by spattering or vapor deposition for example. The preliminary resistor layer 32A is formed as a thin film, having a thickness of 1000-2000 Å and covering substantially the whole area of the upper surface 20 of the material substrate 2.

In the etching treatment, as shown in FIG. 7A, a coating 4 is formed on the preliminary resistor layer 32A. Then, as shown in FIG. 7B, after the removal of a portion of the resistor layer 32A which is not covered with the coating 4, the coating 4 is removed. The coating 4 may be formed by photolithography.

According to the above method, the upper conductor layer 30 as a whole is covered by the resistor layer 30. Thus, the upper conductor layer 30 is protected from the corrosion due to the etching treatment for forming the resistor layer.

Figure 8:
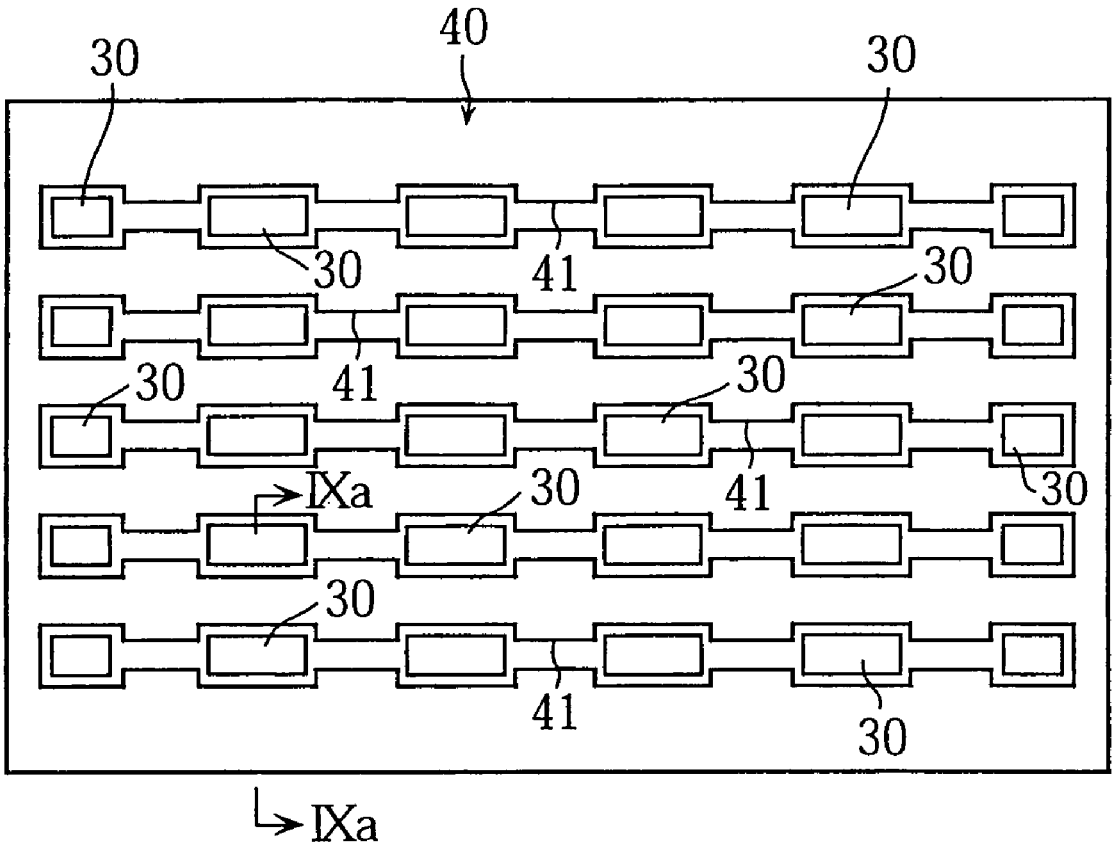
FIG. 8 is a plan view showing a resistor element forming step.
Figure 9A:
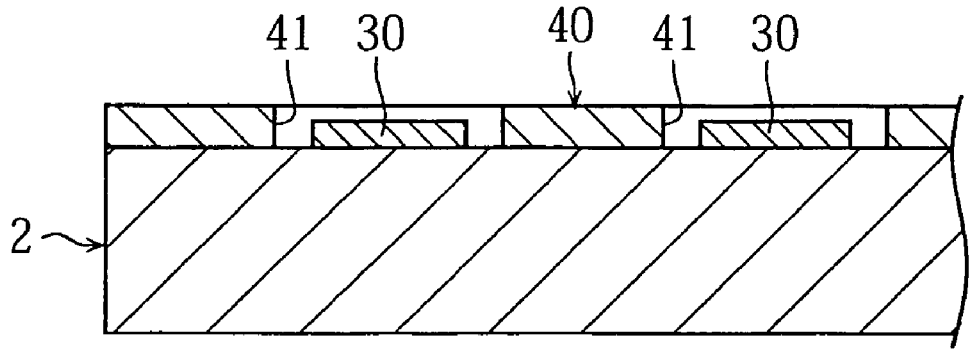
FIG. 9A is a sectional view taken along the line IXa-IXa in FIG. 8.
Figure 9B:
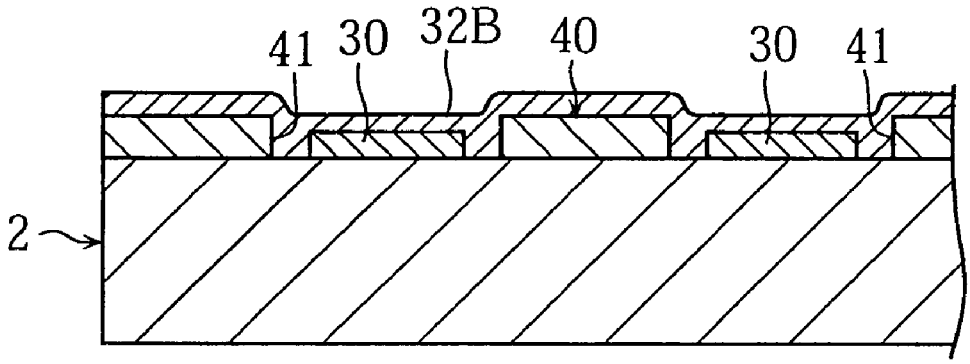
FIG. 9B is a sectional view taken along the line IXa-IXa in FIG. 8 after a step for forming a preliminary resistor layer following the step shown in FIG. 9A.
Figure 9C:
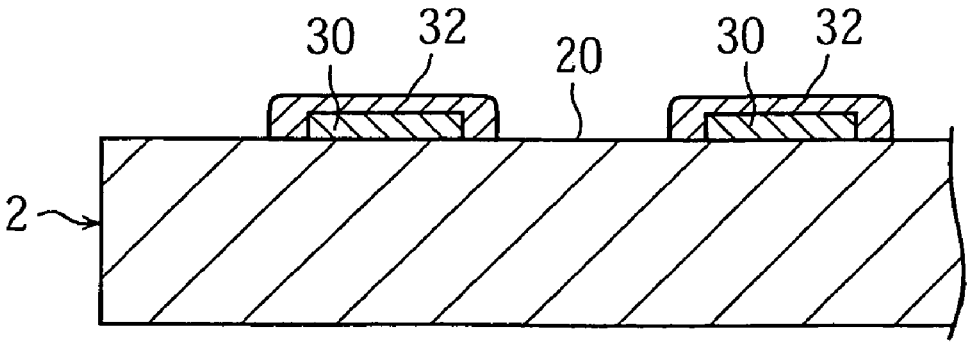
FIG. 9C is a sectional view taken along the line IXa-IXa in FIG. 8 after a step for mask removal following the step shown in FIG. 9B.

The resistor layers 32 can also be formed by steps shown in FIGS. 8 and 9A-9C. First, as shown in FIGS. 8 and 9A, a mask 40 formed with a plurality of openings 41 each capable of containing the upper conductor layer 30 is placed on the material substrate 2. Next, as shown in FIG. 9B, a preliminary resistor layer 32B is formed. The preliminary resistor layer 32B is formed in a thin film made of Ta or Ni-Cr having a thickness of 1000-2000 Å by spattering or vapor deposition. Finally, by removing the mask 40 as shown in FIG. 9C, a plurality of resistor layers 32 are simultaneously formed.

Since this method needs no etching treatment, there is no possibility that the upper conductor layer 30 is eaten in the formation of the resistor layer 32.

In the resistor element forming step described above, the upper conductor layer 30 is protected from corrosion. Thus, the upper conductor layer 30 does not necessarily need to be made of a material having high corrosion resistance, such as gold. Accordingly, resinated silver, which is relatively inexpensive, can be utilized as the organic metal in the formation of the upper conductor layer 30. As a result, the manufacturing cost is kept low.

FIG. 3 shows that the upper electrode forming step A, the lower electrode forming step B, and the resistor element forming step C are performed in this order. However, the order of the steps A-C may be changed.

In a resistance adjustment step D, the resistor layer 32 is irradiated by laser beams while the resistance of the predetermined portion of the resistor layer 32 is being measured. The adjustment of resistance is separately performed with respect to a particular region that is to be the resistor element 12 (see FIGS. 1 and 2) after the material substrate 2 is cut into pieces.

Figure 10:
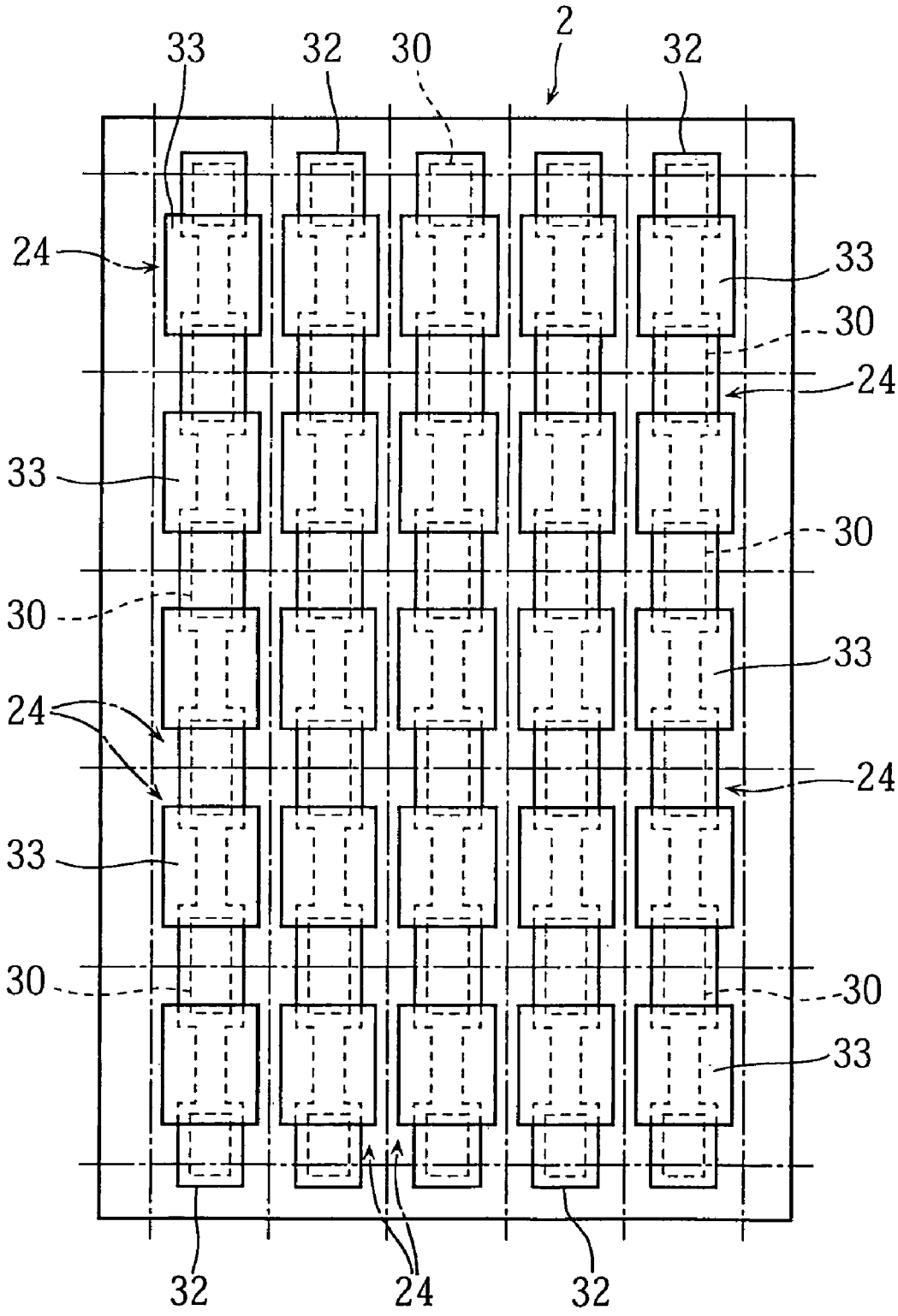
FIG. 10 is a plan view showing a protective layer forming step.

In a protective layer forming step E, highly insulating thermosetting resin is printed and heated to harden. The protective layer 33, as shown in FIG. 10, is formed so as to cover the narrow portion of the resistor element 32. Epoxy resin may be preferably used as thermosetting resin.

Figure 11:
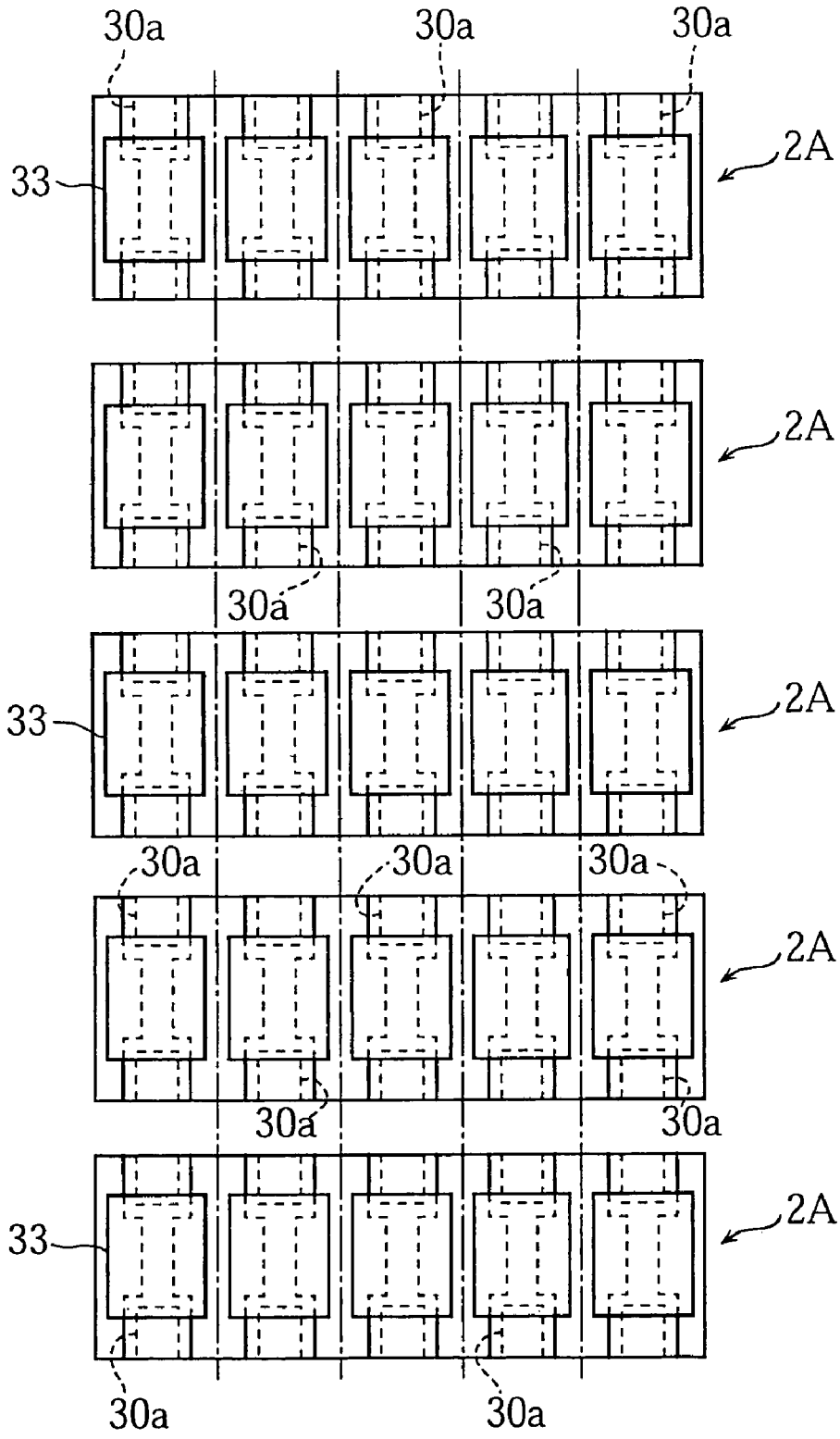
FIG. 11 is a plan view showing a primary dividing step.
Figure 12A:
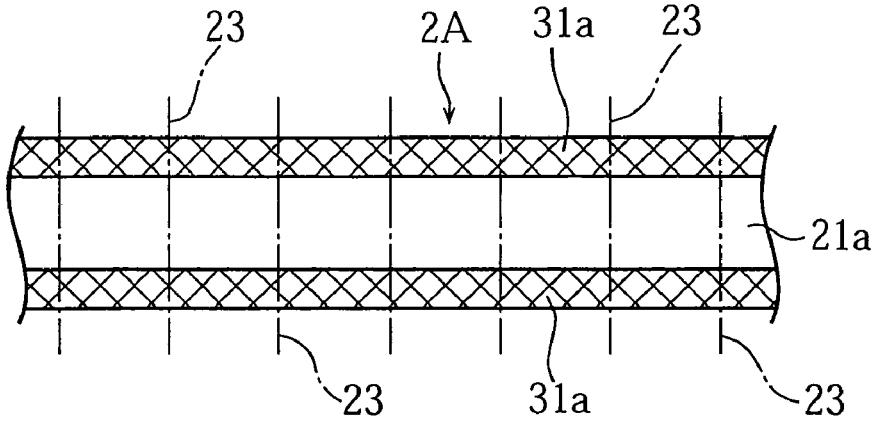
FIGS. 12A~12C are plan views for illustrating the advantages of the method of forming the lower electrode.

A primary cutting step F is performed to cut the material substrate 2 along the first cutting line 22 with a laser beam or a rotatable blade. Thus, the material substrate 2 is divided into a plurality of strips 2A as shown in FIG. 11. At this time, as shown in FIGS. 11 and 12A, the upper conductor layer 30 and the lower conductor layer 31 are divided to be upper conductors layer 30*a* and lower conductor layers 31*a*. Since the lower conductor layer 31 is in the form of a strip, the resultant lower conductor layer 31*b* is also in the form of a strip.

Figure 12B:
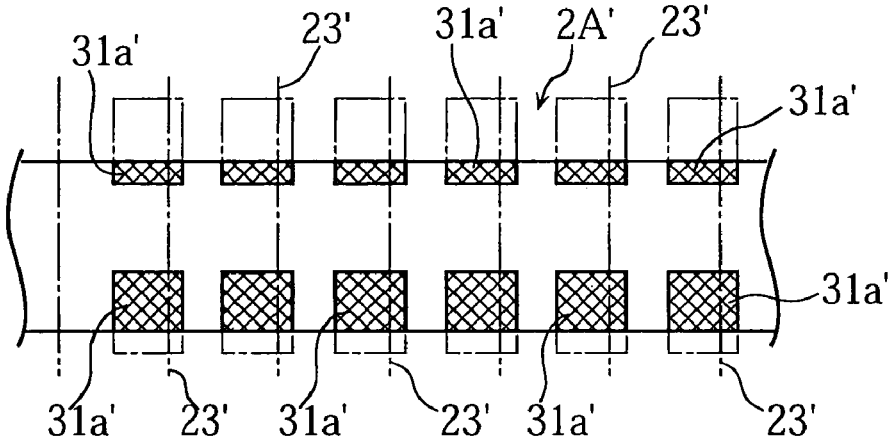
Figure 12C:
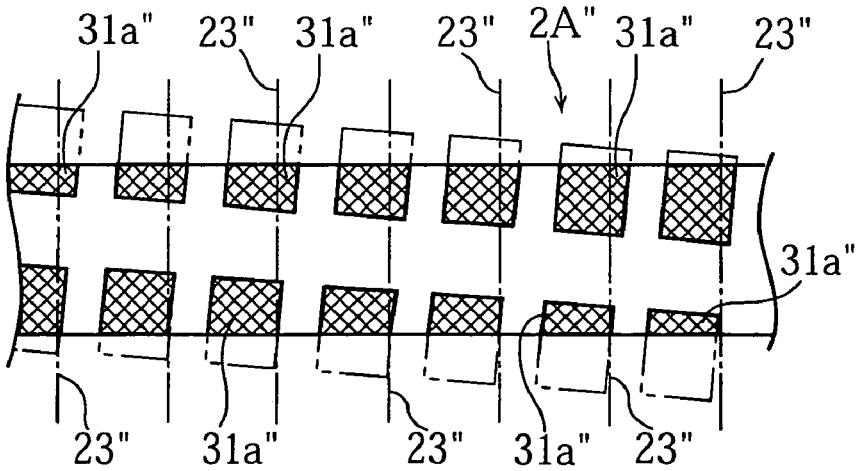

When use is made of the material substrate 2 having no cutting groove, the positioning of a mask cannot be performed by referring to the groove nor the first or second cutting lines 22, 23 at the step of forming the lower conductor layer 31. Consequently, if the lower conductor layer is formed to be distributed along the cutting line 23, like the upper conductor layer 30, the lower conductor layer 31*a*', 31*a*" may fail to be formed as desired due to a deviation of the mask from a suitable portion, as shown in FIGS. 12B and 12C. Under such circumstances, in cutting the strips 2A' or 2A" into pieces along the cutting line 23' or 23", the lower electrode of each piece may be formed out of alignment and therefore is unsuitable to be mounted on a circuit board. As a result, yielding percentage may be decreased.

On the other hand, as shown in FIG. 12A, when the lower conductor layer 31*a* is formed to extend along the lower surface 21*a* of the strip 2A and is cut along the second cutting line 23, lower conductor electrodes are properly formed at the end portions of the lower surface of each cut piece in the form of a strip extending across the end portion. This means that, even with use of a material substrate provided with no positioning criteria such as cutting grooves, no positioning deviation arises in the longitudinal direction of the lower electrode. As a result, it is possible to reduce the number of defective products to be mounted on a circuit board, whereby the decline in the yield is prevented.

Figure 13:
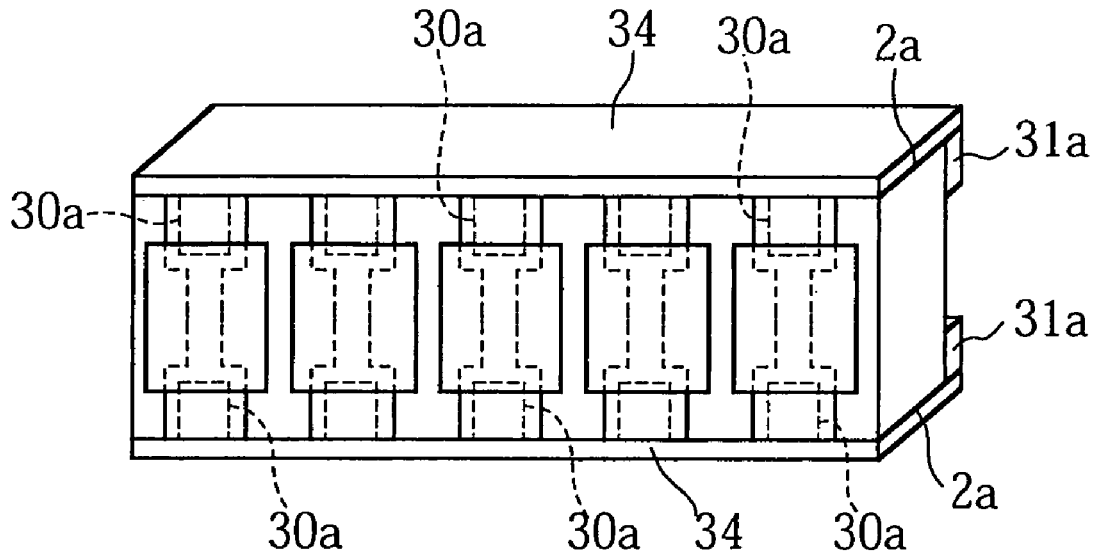
FIG. 13 is a perspective view showing an end electrode forming step.
Figure 14:
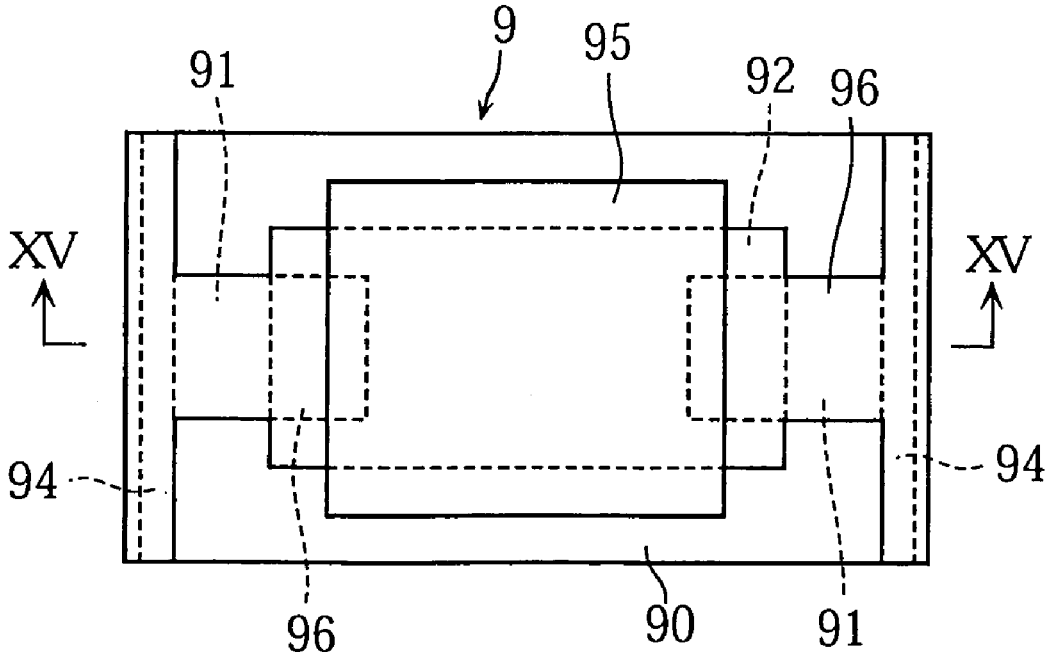
FIG.14 PRIOR ART
FIG. 14 is a plan view illustrating an example of a chip resistor provided by a conventional method.
Figure 15:
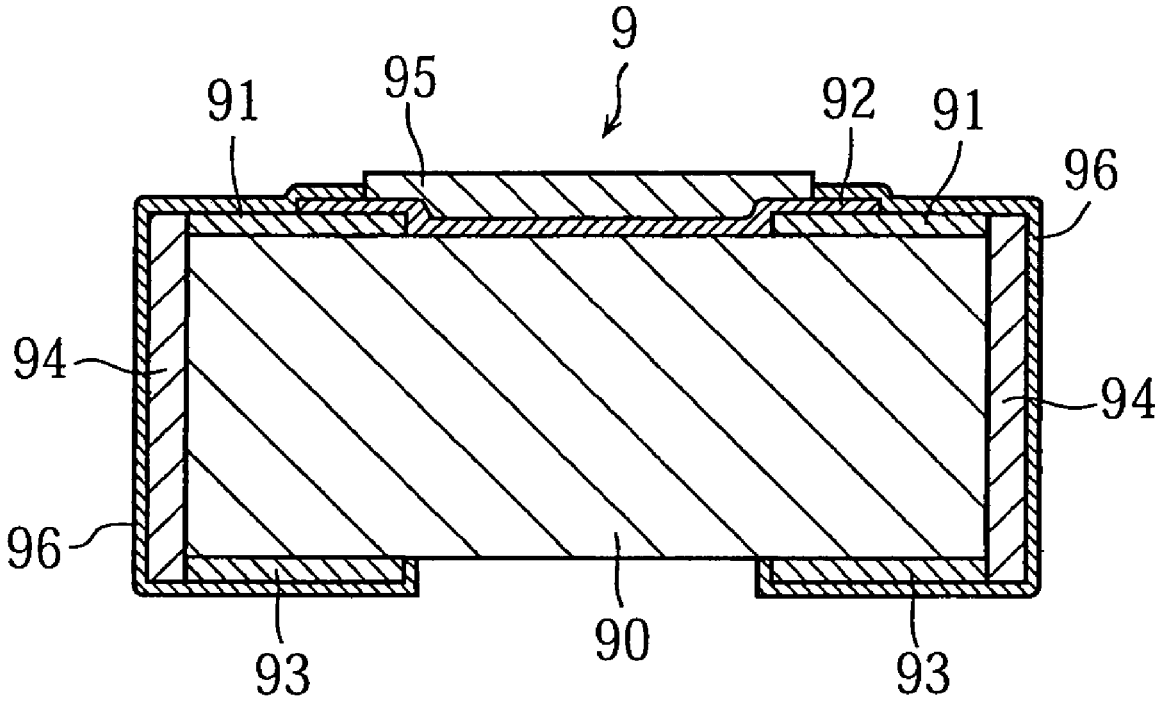
FIG.15 PRIOR ART
FIG. 15 is a sectional view taken along the line XV-XV in FIG. 14.
Figure 16A:
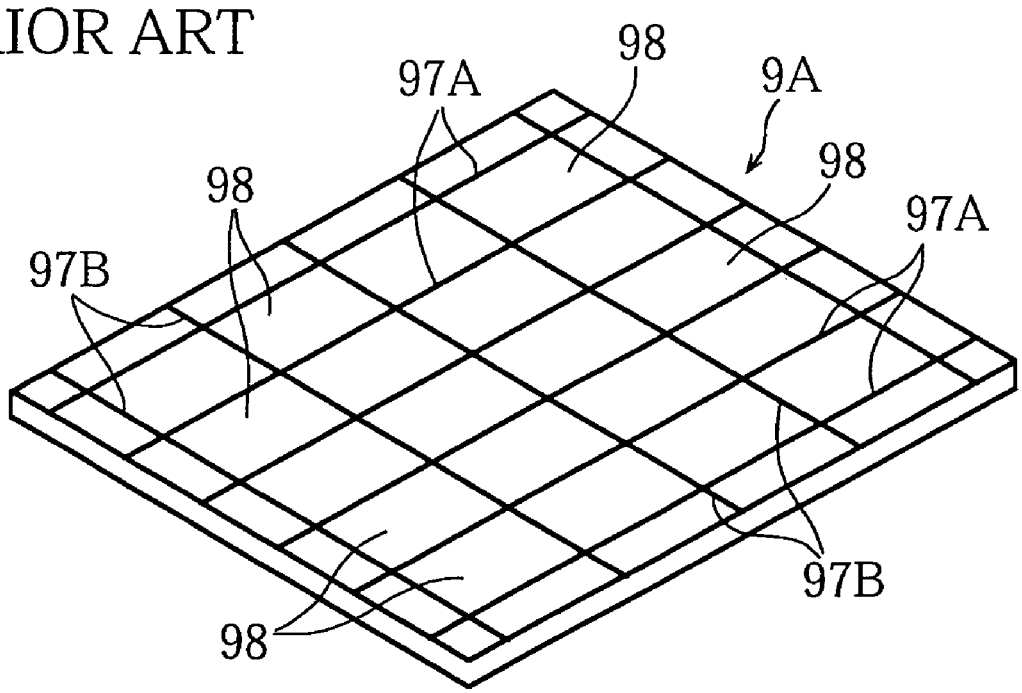
FIG. 16A PRIOR ART
FIG. 16A is a perspective view illustrating an example of a material substrate used in the conventional method.
Figure 16B:
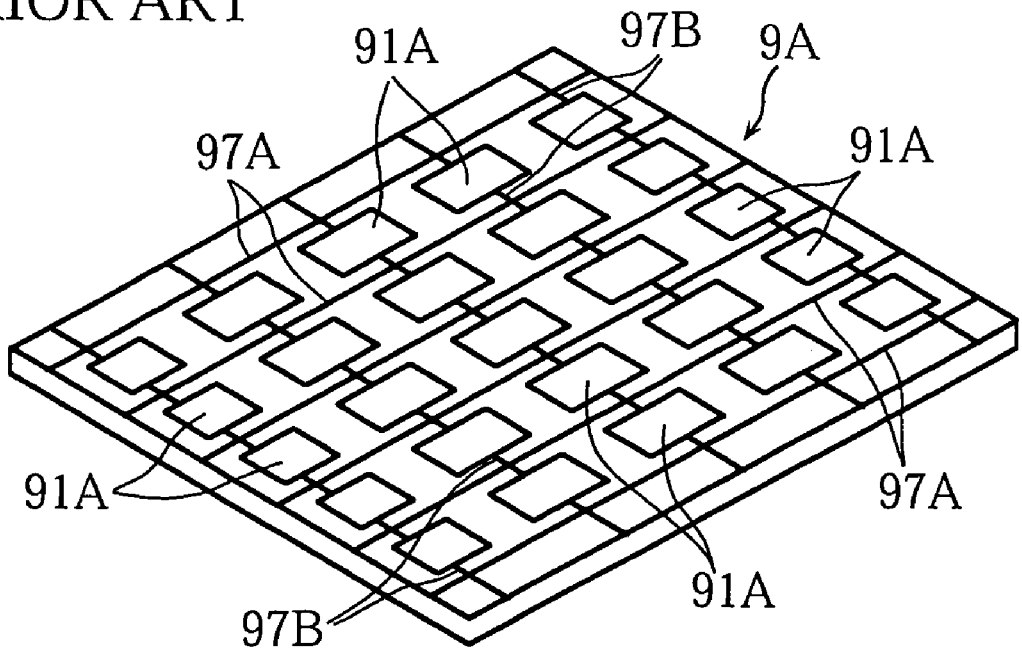
FIG. 16B PRIOR ART
FIG. 16B is a perspective view of the material substrate of FIG. 16A formed with a conductor layer to be an upper electrode.
Figure 17:
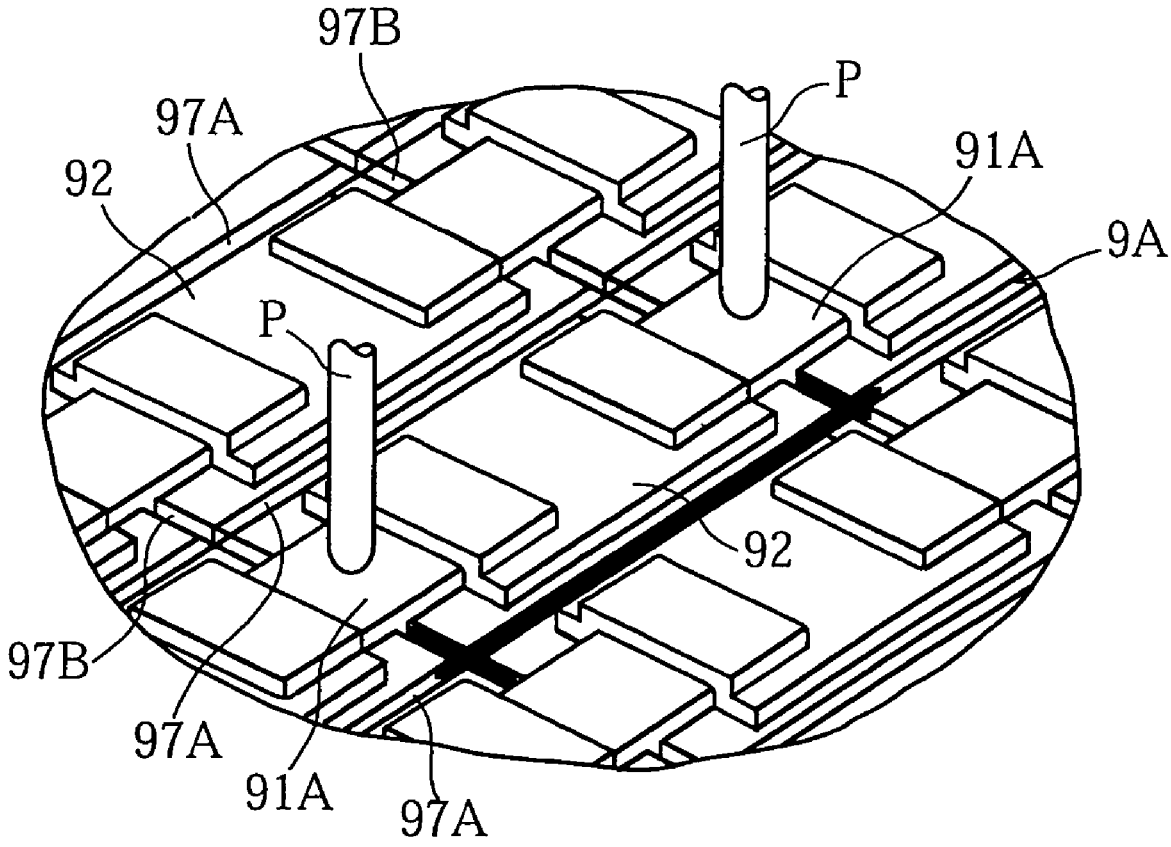
FIG. 17 PRIOR ART
FIG. 17 is a relevant perspective view showing an action of measuring a resistance of a resistor layer.

In an end electrode forming step G, the conductive resin paste may be printed on an end surface of the strip and then dried. As shown in FIG. 13, this step forms an end conductor layer 34 on the end surface 2*a* of the strip 2A. The end conductor layer 34 connects the upper conductor layer 30*a* and the lower conductor layer 31*a*. The end conductor layer 34 may have a thickness of 10-30 μm.

In a secondary cutting step H, the strip 2A is cut along the second cutting line 23 into a plurality of pieces. The secondary cutting step H can be performed with a laser beam or a rotatable blade as in the primary cutting step F. Cutting with a laser beam or a rotatable blade needs no application of external force on the material substrate, unlike the cutting of a material substrate with dividing grooves. Since this prevents the chip from being chipped off, the shape of the chip is stabilized, which reduces the possibility that an imperfect chip resistor X is mounted on the circuit board.

A plating step I may be performed by electrolytic plating. In the electrolytic plating, a plating layer is formed on a portion of the resistor layer 32 which is not covered with the protective layer 33, and on the surfaces of the end conductor layer 34 and on the lower conductor layer 31*a*. The plating layer may be formed as a Ni-layer or a Sn-layer made from an electrolytic solution including Ni-ion or Sn-ion. The Ni-layer or the Sn-layer has a thickness of 1-10 μm for example.

In this embodiment, the upper electrode 11 and the lower electrode 13 are formed from the metal organic paste, the end electrode 14 is formed from the conductive resin paste, and the resistor 12 is formed by a depositing technique. The metal organic paste is obtained by dissolving organic metal in a solvent, while the conductive resin paste is resin paste (formed by dissolving resin in a solvent) dispersed with a conductive material. Thus, the organic metal and the conductive material does not need to contain lead. Further, for a binder, use is made of material other than lead glass. Therefore, the upper electrode 11, the lower electrode 13, and the end electrode 14 can be free from lead. In the depositing technique, the resistor component is directly formed into a layer. Thus, the resistor element 12 can be free from lead when the material for forming the resistor element includes no lead. Since each electrode 11, 13, 14 and the resistor element 12 can be free from lead, the chip resistor X obtained by the present invention can realize a lead-free production.

In the method of making the chip resistor X utilizing the material substrate 2 with no cutting grooves, the problem caused by the material paste flowing into the cutting groove does not arise. Thus, upper electrodes 30 adjacent on the material substrate are not unduly connected to each other, which ensures proper measurement of the resistance of the resistor layer 32. Further, substantially no unnecessary material paste is left on a fringe portion of the chip resistor X, which results in preventing the deterioration of appearance. When the chip needs to be smaller, the thickness of the material substrate 2 should be reduced. Even in such an instance, the material substrate 2 is less susceptible to breakage in the printing step, the baking step, etc., since the material substrate 2 has no dividing grooves. As a result, the yielding percentage is increased, with the percentage of defects reduced, and the production cost can be reduced.

The invention claimed is:

1. A chip resistor comprising:

a substrate having a first surface and a second surface opposite the first surface;

a pair of thick first electrodes made of a metal organic paste on the first surface of the material substrate;

a pair of thick second electrodes made from a metal organic paste on the second surface of the material substrate; and a thin film resistor element connecting between the paired first electrodes on the first surface of the material substrate, wherein the thin film resistor element has a pair of lifted end portions formed over the pair of first electrodes and entirely covering the pair of first electrodes.

2. The chip resistor according to claim 1, further comprising a third electrode connecting the first electrode and the second electrode;

wherein the third electrode is formed thick with use of a conductive resin paste.

3. The chip resistor according to claim 1, wherein the resistor element has a central portion that is narrower than the pair of end portions.

* * * * *